US009705228B2

(12) United States Patent
Caldwell et al.

(10) Patent No.: US 9,705,228 B2
(45) Date of Patent: Jul. 11, 2017

(54) CONNECTOR SYSTEM WITH DISCONNECTION EVIDENT CONNECTOR POSITION ASSURANCE FEATURE

(71) Applicant: Delphi Technologies, Inc., Troy, MI (US)

(72) Inventors: Bart N. Caldwell, West Farmington, OH (US); John L. Jablonski, Burghill, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 14/830,786

(22) Filed: Aug. 20, 2015

(65) Prior Publication Data

US 2017/0054244 A1 Feb. 23, 2017

(51) Int. Cl.
*H01R 13/44* (2006.01)
*H01R 13/436* (2006.01)

(52) U.S. Cl.
CPC ..... *H01R 13/4365* (2013.01)

(58) Field of Classification Search
CPC ..... H01R 13/4365
USPC ..... 439/138
See application file for complete search history.

(56) References Cited

U.S. PATENT DOCUMENTS 5,609,498 A 3/1997 Muzslay
6,068,507 A 5/2000 Popa
6,093,045 A 7/2000 Hoff
6,435,895 B1 * 8/2002 Fink ..... H01R 13/6272 439/352
6,537,099 B2 3/2003 Herlinger et al.
6,884,106 B2 4/2005 Shuman et al.
7,326,074 B1 * 2/2008 Lim ..... H01R 13/629 439/352
8,616,914 B2 * 12/2013 Mumper ..... H01R 13/6272 439/489

(Continued)

FOREIGN PATENT DOCUMENTS

EP 803939 A2 7/2001
EP 2876744 A1 5/2015
WO 2011069611 A1 6/2011

OTHER PUBLICATIONS

US 8,298,013, 10/2012, Myer et al. (withdrawn)

*Primary Examiner* — Abdullah Riyami
*Assistant Examiner* — Nader Alhawamdeh
(74) *Attorney, Agent, or Firm* — Robert J. Myers

(57) ABSTRACT

A connector system including a first connector body, a second connector body configured to mate with the first connector body, a locking feature configured to secure the second connector body to the first connector body, and a connector position assurance (CPA) device that, when engaged, inhibits operation of the locking feature. A portion of the second connector body and the CPA device cooperate to form a box to completely enclose the locking feature, thereby inhibiting disengagement of the CPA device from the locking feature. The CPA device has a flexible lock arm configured to secure the CPA device to the second connector body. A portion of the CPA lock arm may be configured to be frangible. The second connector body and/or the CPA device may define an aperture configured to provide access to the CPA lock arm. The aperture is at least partially blocked by a frangible tab.

4 Claims, 8 Drawing Sheets

(56) References Cited

U.S. PATENT DOCUMENTS

| | | | | |
|---|---|---|---|---|
| 8,968,021 | B1 * | 3/2015 | Kennedy | H01R 13/6273 439/352 |
| 9,147,971 | B2 * | 9/2015 | Osada | H01R 13/641 |
| 2006/0288968 | A1 | 12/2006 | Damian | |
| 2011/0021060 | A1 * | 1/2011 | Urano | H01R 13/6272 439/352 |
| 2013/0316560 | A1 * | 11/2013 | Yoon | H01R 13/62 439/345 |

* cited by examiner

CONNECTOR SYSTEM WITH DISCONNECTION EVIDENT CONNECTOR POSITION ASSURANCE FEATURE

TECHNICAL FIELD OF THE INVENTION

The invention relates to a connector system having a connector position assurance (CPA) device, particularly to a CPA device that is designed to inhibit disconnection of the connector and/or to provide evidence of disconnection of the connector.

BACKGROUND OF THE INVENTION

It is occasionally desirable to provide electrical connectors which may be mechanically and electrically connected together but not readily disconnected. For example, the unauthorized disconnection of sensors or actuators may disable safety or emission control systems, causing the vehicle to be in violation of regulations and possible void the vehicle manufacturer's warranty. One known feature to deter disconnection of electrical connectors involves using threaded fasteners, such as nuts and bolts to hold mated connectors together. The use of threaded fasteners in this manner is inherently time consuming, discouraging disconnection of the electrical connector but also undesirably increasing labor cost and time for assembling the connector. In addition, space limitations may impede effecting the connection. Further, such a connection may be disconnected by merely unthreading the threaded fasteners. Another known features relies upon a friction fit having a high unmating force to hold mating parts together. However an automotive environment may cause this type of connection to vibrate loose. In addition, such a connection may be disconnected merely by using enough force to pull the connectors apart. It is also known to provide mating connector housings which have a locking feature to are snap fit the housings together. These connectors rely upon the use of connector position assurance (CPA) devices. In structures of this type the CPA device engages the locking feature to prevent activation of the locking feature. Such a connection may still be disconnected by disengaging the CPA device from the locking feature. In addition, none of these described connectors show any evidence of unauthorized disconnection without the addition of other features, such as seals.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention a connector system is provided. The connector system includes first connector body and a second connector body configured to mate with the first connector body. The connector system also includes a locking feature that is configured to secure the second connector body to the first connector body. The connector system further includes a connector position assurance (CPA) device that, when engaged, inhibits operation of the locking feature. A portion of the second connector body and the CPA device cooperate to enclose the locking feature, thereby inhibiting access to the CPA device and inhibiting disengagement of the CPA device from the locking feature.

The locking feature may further include a connector latch defined by the first connector body and a flexible connector lock arm defined by the second connector body. The flexible connector lock arm is configured to engage the connector latch, thereby securing the second connector body to the first connector body. The CPA device may further include a tongue that, when engaged with the connector lock arm, inhibits disengagement of the connector lock arm from the connector latch. The first connector body may include a first electrical terminal and the second connector body includes a second electrical terminal configured to mate with the first electrical terminal.

The portion of the second connector body and the CPA device may cooperate to completely enclose the tongue and the connector lock arm when the CPA device is engaged with the connector lock arm. The portion of the second connector body and the CPA device may cooperate to form a box around the tongue of the CPA device and the connector lock arm.

The CPA device may have a flexible CPA lock arm configured to engage the connector lock arm and secure the CPA device to the second connector body, thereby further inhibiting disengagement of the CPA device from the connector lock arm. The portion of the second connector body and the CPA device cooperate to enclose the CPA lock arm. The portion of the second connector body and the CPA device may cooperate to completely enclose the tongue and the connector lock arm when the CPA lock arm is engaged with the connector lock arm. A portion of the CPA lock arm is configured to be frangible. The second connector body and/or the CPA device may defines an aperture configured to provide access to the CPA lock arm. The aperture is at least partially blocked by a frangible tab.

Alternatively or in addition, the CPA device may define a flexible CPA lock arm and the second connector body may have a CPA latch configured to engage the CPA lock arm and secure the CPA device to the second connector body, thereby further inhibiting disengagement of the CPA device from the connector lock arm. The portion of the second connector body and the CPA device cooperate to enclose the CPA latch and the CPA lock arm. The portion of the second connector body and the CPA device may cooperate to completely enclose the tongue and the connector lock arm when the CPA lock arm is engaged with the CPA latch. The second connector body and/or the CPA device may define an aperture configured to provide access to the CPA lock arm. The aperture is at least partially blocked by a frangible tab. A portion of the CPA lock arm may be configured to be frangible.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A connector system having a locking feature and a connector position assurance (CPA) device is presented herein. The locking feature is designed to secure a first connector body to a second connector body when they are fully mated. The CPA device is designed to inhibit or prevent operation of the locking feature that would result in disconnection of the first connector body from the second connector body. The CPA device may also be designed to provide evidence of disconnection of the first connector body from the second connector body. This connector system may be used to provide connections that cannot be disconnected once they are established. The connector system may also in applications where indication of disconnection is desired, for example for maintaining or voiding a manufacturer's warranty.

Figure 1:
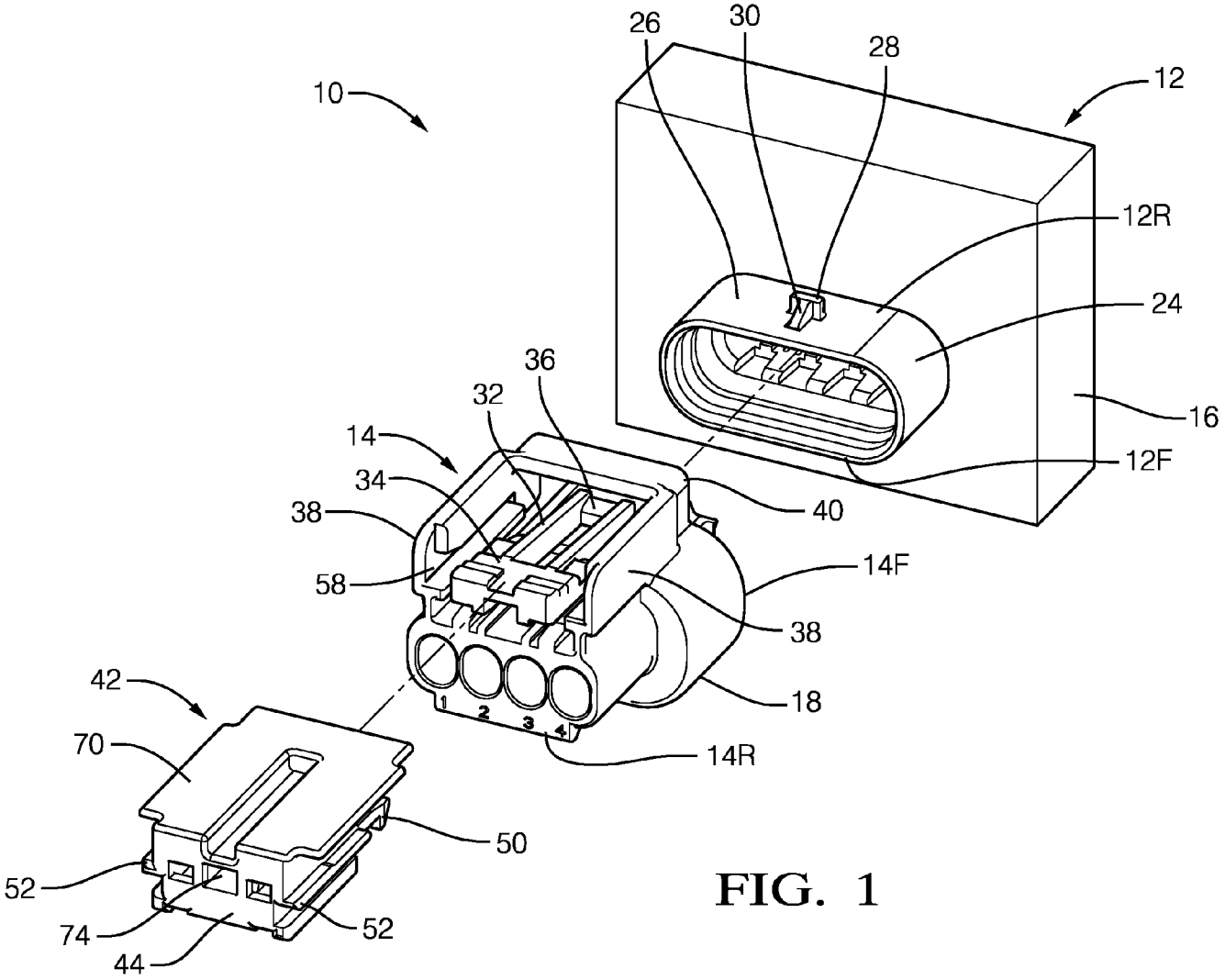
FIG. 1 is an exploded perspective view of a connector system having a locking feature and a connector position assurance device according to one embodiment.

FIG. 1 illustrates a non-limiting example of a connector system 10, in this example for establishing an electrical connection. The connector system 10 includes a first connector 12 and a second connector 14 configured to mate with the first connector 12 along a longitudinal axis X. Both the first and second connectors 12, 14 have a front end 12F, 14F and a rear end 12R, 14R, the front ends 12F, 14F corresponding to the mating ends of the first and second connectors 12, 14. The first and second connectors 12, 14 are based around first and second connector bodies 16, 18. The first and second connector bodies 16, 18 are formed of dielectric material such as polybutylene terephthalate (PBT), polypropylene (PP), or polyamide (PA, commonly known as NYLON). The first connector body 16 defines a plurality of terminal cavities (not shown) containing electrical terminals (not shown). These electrical terminals are configured to connect with corresponding mating electrical terminals (not shown) contained in terminal cavities defined in the second connector body 18. The electrical terminals are connected to wire cables (not shown) or other electrical conductors (not shown) such as bus bars or circuit board traces and are formed of a conductive material, such as a copper alloy.

The first connector 12 is a receptacle connector configured to receive the second connector 14 which is a plug connector. The first connector 12 in the illustrated example is configured to be mounted to a panel or bulkhead (not shown), however alternative embodiments of the first connector configured to terminate the end of a wire cable may also be envisioned. The first connector body 16 includes a shroud 24 that extends forwardly, i.e. toward the second connector 14 when the first and second connectors 12, 14 are to be mated. The shroud 24 longitudinally surrounds the electrical terminals and is configured to receive the second connector body 18 when mated. A top wall 26 of the shroud 24 defines a connector latch 28 which is part of a locking feature configured to secure the second connector 14 to the first connector 12. The connector latch 28 has a forwardly facing chamfered surface 30 and projects upwardly from the top wall 26. The connector latch 28 is located generally on the central portion of the top wall 26.

The second connector body 18 includes a flexible connector lock arm 32 that is also part of the locking feature configured to secure the second connector 14 to the first connector 12. The second connector 14 in the illustrated example is configured to terminate the end of a wire cable, however alternative embodiments of the second connector configured to be mounted to a panel or bulkhead may also be envisioned. The connector lock arm 32 has a pressing area 34 near the rear end 14R of the second connector 14. This pressing area 34 is accessible to an operator's finger (not shown) so that by pushing down on the pressing area 34 a catch portion 36 of the connector lock arm 32 is caused to pivot upwardly. The second connector 14 includes a pair of side walls 38 projecting upwardly from the second connector body 18 that extend longitudinally, i.e. parallel to the longitudinal axis, on each side of the connector lock arm 32. The second connector body 18 also includes a front wall 40 located forward of the connector lock arm 32 extending laterally, i.e. perpendicularly to the longitudinal axis X. The ends of the front wall 40 are interconnected to the forward ends of the side walls 38.

Figure 2:
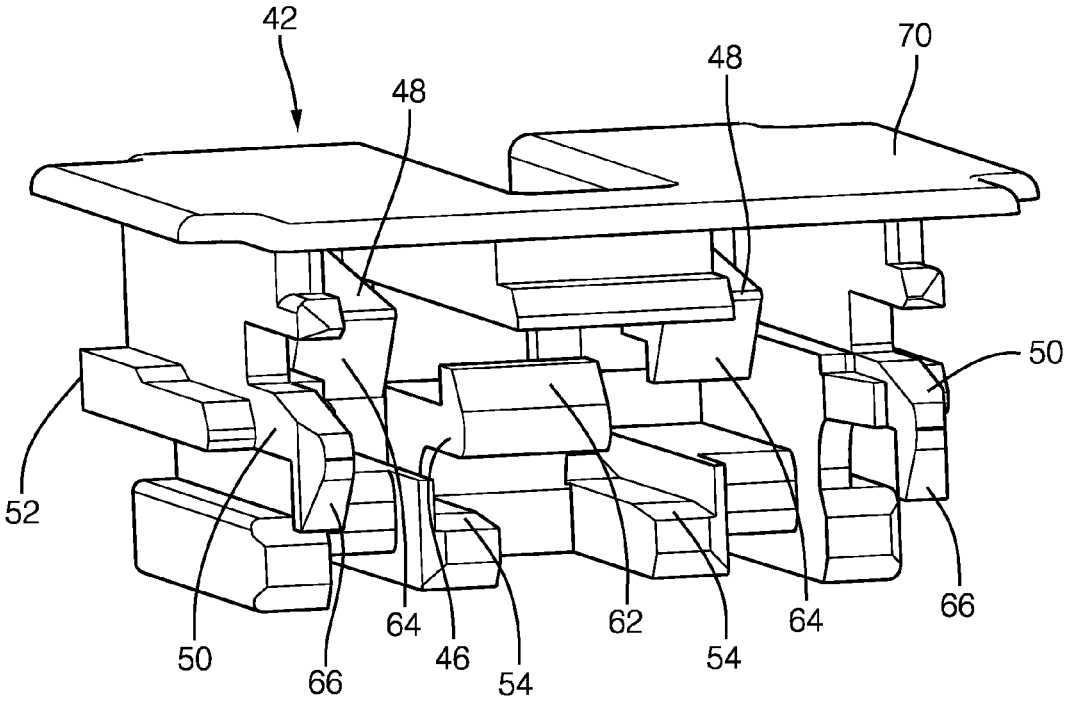
FIG. 2 is a perspective view of the CPA device of FIG. 1 according to one embodiment.

The connector system 10 further includes a connector position assurance (CPA) device 42 shown in FIG. 2 that is formed of a dielectric material, such as PBT, PP, or NYLON. The CPA device 42 has a rear wall 44 extending laterally that is designed to be accommodated at the rear end 14R of the second connector 14. The CPA device 42 has a tongue 46, a first pair and a second pair of CPA lock arms 48, 50, and two guiding ribs 52 extending forwardly from the rear wall 44. The CPA device 42 also includes a shelf 54 extending forwardly from the rear wall 44. The tongue 46, as explained below, is configured to engage the pressing area 34 of the connector lock arm 32. The first pair of CPA lock arms 48 is also configured to engage the pressing area 34 of the connector lock arm 32. The second pair of pair of CPA lock arms 50 is configured to engage a latching feature 56 on the side walls 38 of the second connector 14. Each one of the guiding ribs are laterally located on a respective outer side of the second CPA lock arms 50 and are designed to engage longitudinal guiding grooves 58 defined in the inner sides of the side walls 38.

Referring again to FIG. 1, the connector lock arm 32 extends forwardly from the pressing area 34 to the catch 36. More precisely, the catch 36 has a U-shape with two branches extending essentially forwardly from the pressing area 34 and joined at a front end of the connector lock arm 32 by a transverse branch. The transverse branch has a slanted front surface and an upright rear surface. When the CPA device 42 is mounted on the second connector 14, from its rear end 14R, the tongue 46 is inserted below the pressing area 34, the first pair of CPA lock arms 48 are inserted over the pressing area 34, and the second pair of CPA lock arms 50 are inserted on each side of the pressing area 34. The first and second pairs of CPA lock arms 48, 50 are flexible so that they can elastically deform.

When the second connector 14 is mated to the first connector 12, the shroud 24 of the first connector body 16 gets at least partially under the a portion of the second connector body 18. The forwardly facing chamfered surface 30 of the connector latch 28 inserts below the catch 36 of the connector lock arm 32 and moves the catch 36 upwardly. When the catch 36 moves up, the connector lock arm 32 pivots about the fulcrum and the pressing area 34 moves down, blocking the tongue 46 and first CPA lock arms 48 so that the CPA device 42 cannot be fully inserted into the second connector 14. The first and second connectors 12, 14 are further connected until they come into abutment and are fully mated. At this stage, the catch 36 falls behind the connector latch 28 and the pressing area 34 moves upward so that the CPA device 42 is no longer blocked by the catch 36 can be pushed forward in its final position as shown in FIG. 3.

Figure 3:
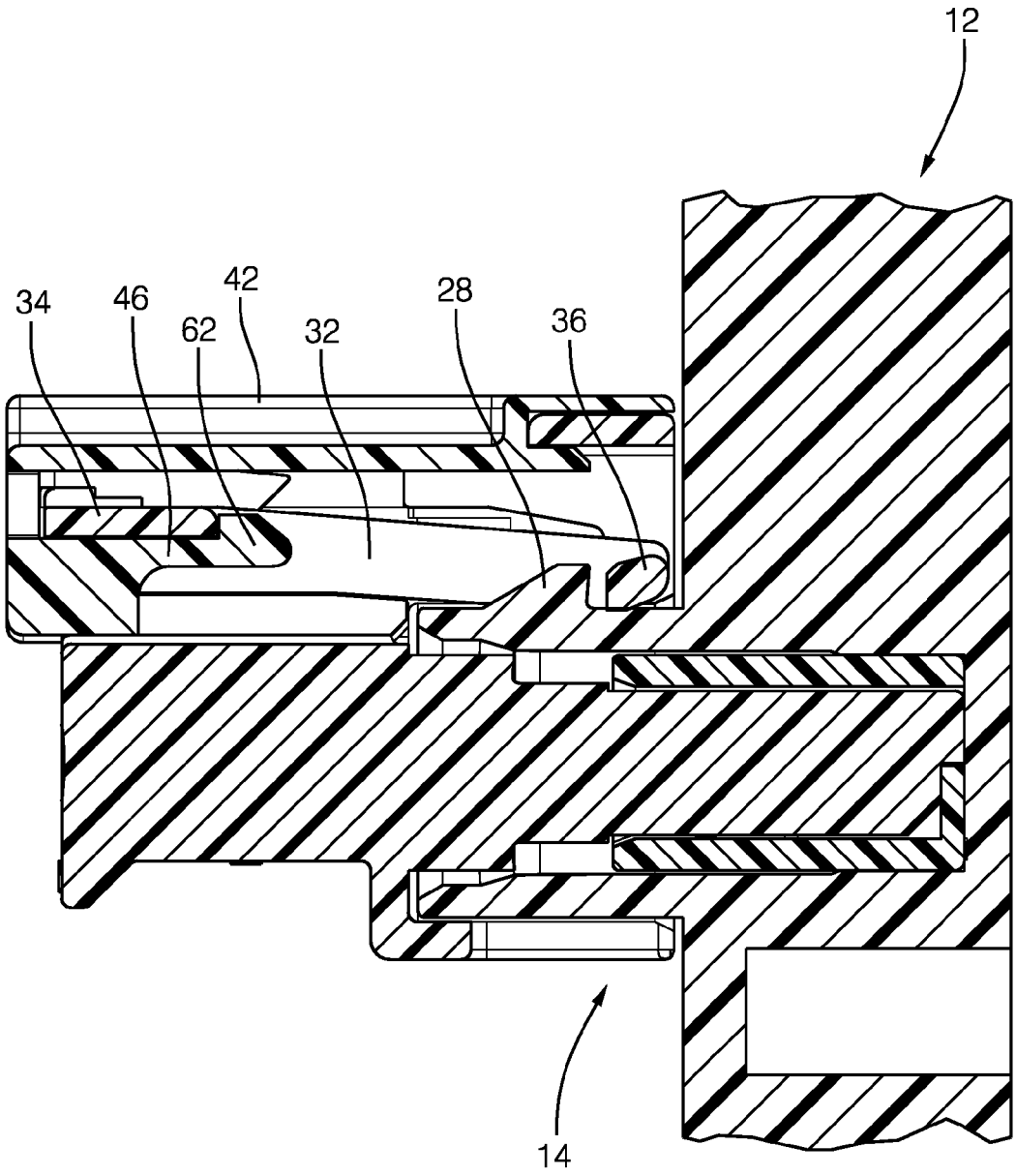
FIG. 3 is a cut-away side view of the connector system of FIG. 1 according to one embodiment.

As shown in FIG. 3, the CPA device 42 is moved into its final position, the tongue 46 is inserted under the pressing area 34 until a tooth 62 extending upwardly from a free end of the tongue 46 engages the forward end of the pressing area 34 and is disposed between the two branches of the connector lock arm 32 when in the final position. The tongue 46 inhibits the pressing area 34 from being depressed by an operator's finger, this inhibiting the catch 36 from releasing the connector latch 28 and maintaining the full connection between the first and second connectors 12, 14.

Figure 4:
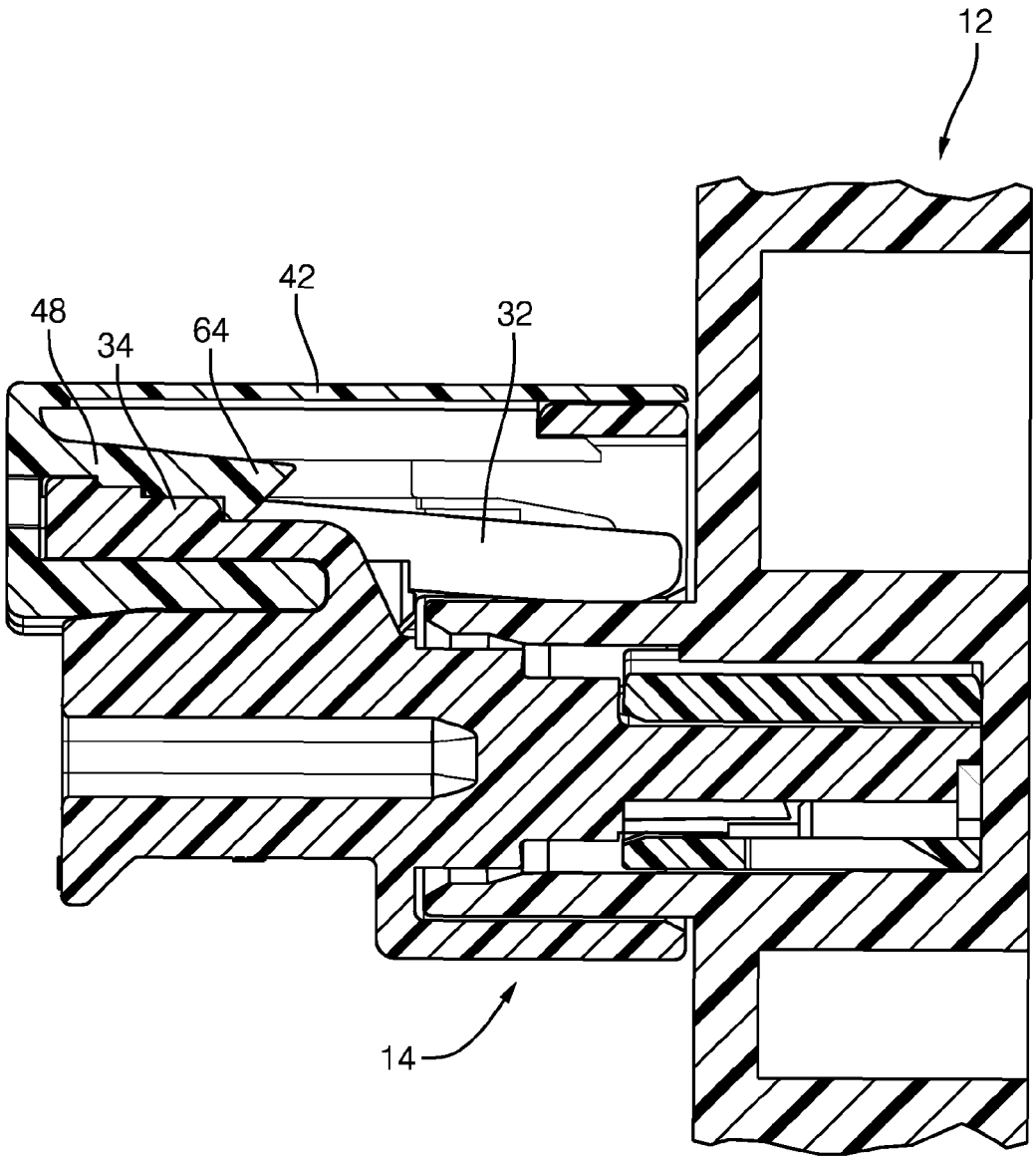
FIG. 4 is another cut-away side view of the connector system of FIG. 1 according to one embodiment.

As shown in FIG. 4, the first CPA lock arms 48 are inserted over the pressing area 34 and are disposed outwardly from the two branches until a tooth 64 extending downwardly from each of the first CPA lock arms 48 engages the forward end of the pressing area 34 when in the final position. The first CPA lock arms 48 cooperate to maintain the CPA device 42 in its final position.

Figure 5:
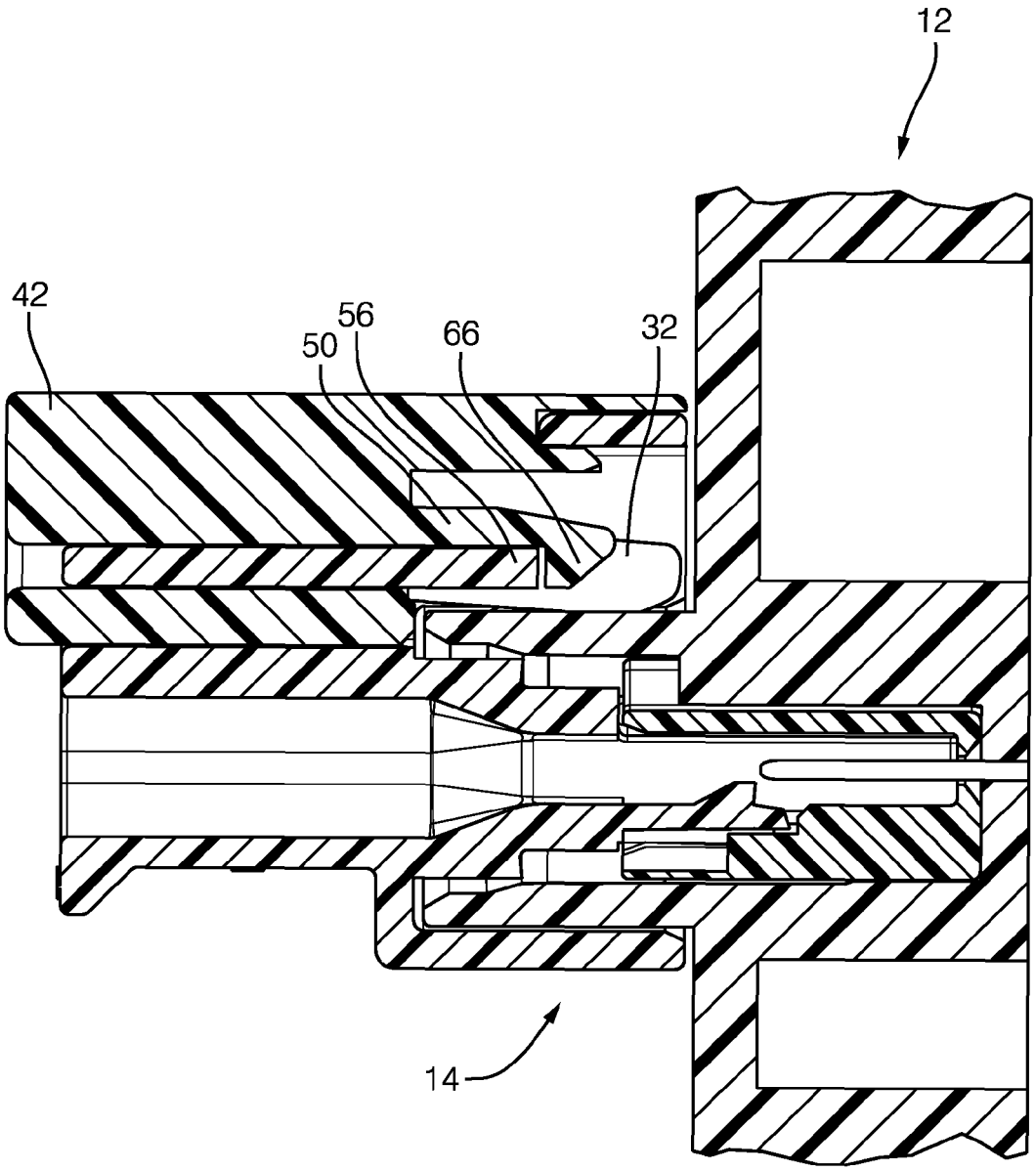
FIG. 5 is yet another cut-away side view of the connector system of FIG. 1 according to one embodiment.

As illustrated in FIG. 5, the second CPA lock arms 50 are inserted between the side walls 38 until a tooth 66 extending downwardly from each of the second CPA lock arms 50 engage the latching feature 56 extending inwardly from each side wall 38. The second CPA lock arms 50 also cooperate to maintain the CPA device 42 in its final position. The shelf 54 is inserted underneath the pressing area 34 between the pressing area 34 and the top of the second connector body 18, further inhibiting the pressing area 34 from being depressed.

Referring once more to FIG. 1, the CPA device 42 further defines a top wall 70 abutting the rear wall 44 of the CPA device 42 and extending forwardly to the front wall 40 and laterally to each of the side walls 38 when in the final position so that the connector lock arm 32, the tongue 46, and the first and second CPA lock arms 48, 50 are enclosed within the a box formed between the top wall 70, the side walls 38, the front wall 40, the rear wall 44, and the second connector body 18. This box prevents access to the pressing area 34 of the connector lock arm 32 averting an operator from moving the CPA device 42 the final position and/or averting an operator from releasing the connector latch 28 from the catch 36. Thus, once the CPA device 42 is moved to the final position, the first and second connectors 12, 14 can no longer be disconnected and the connection between the first and second connector 14 is more or less permanent. It may be possible to pry the CPA device 42 from its final position, however prying the CPA device 42 would likely damage the CPA device 42 and/or the second connector 14 providing visual evidence of disconnecting the first and second connectors 12, 14.

Figure 6:
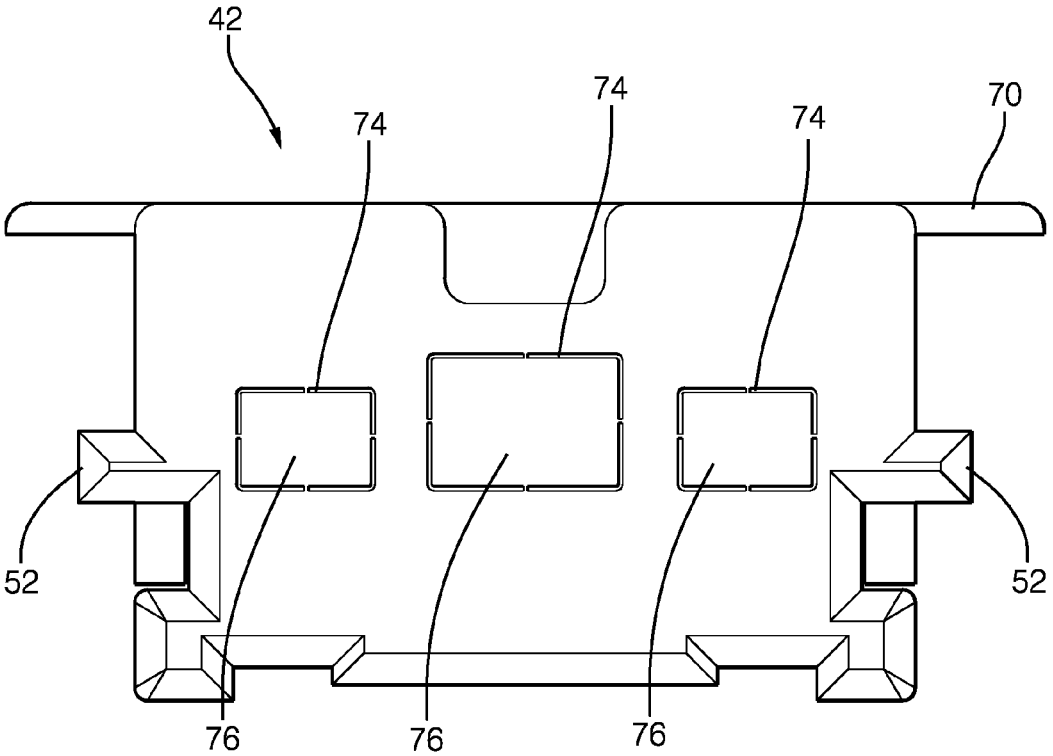
FIG. 6 is a rear view of the CPA device of FIG. 1 according to one embodiment.
Figure 7:
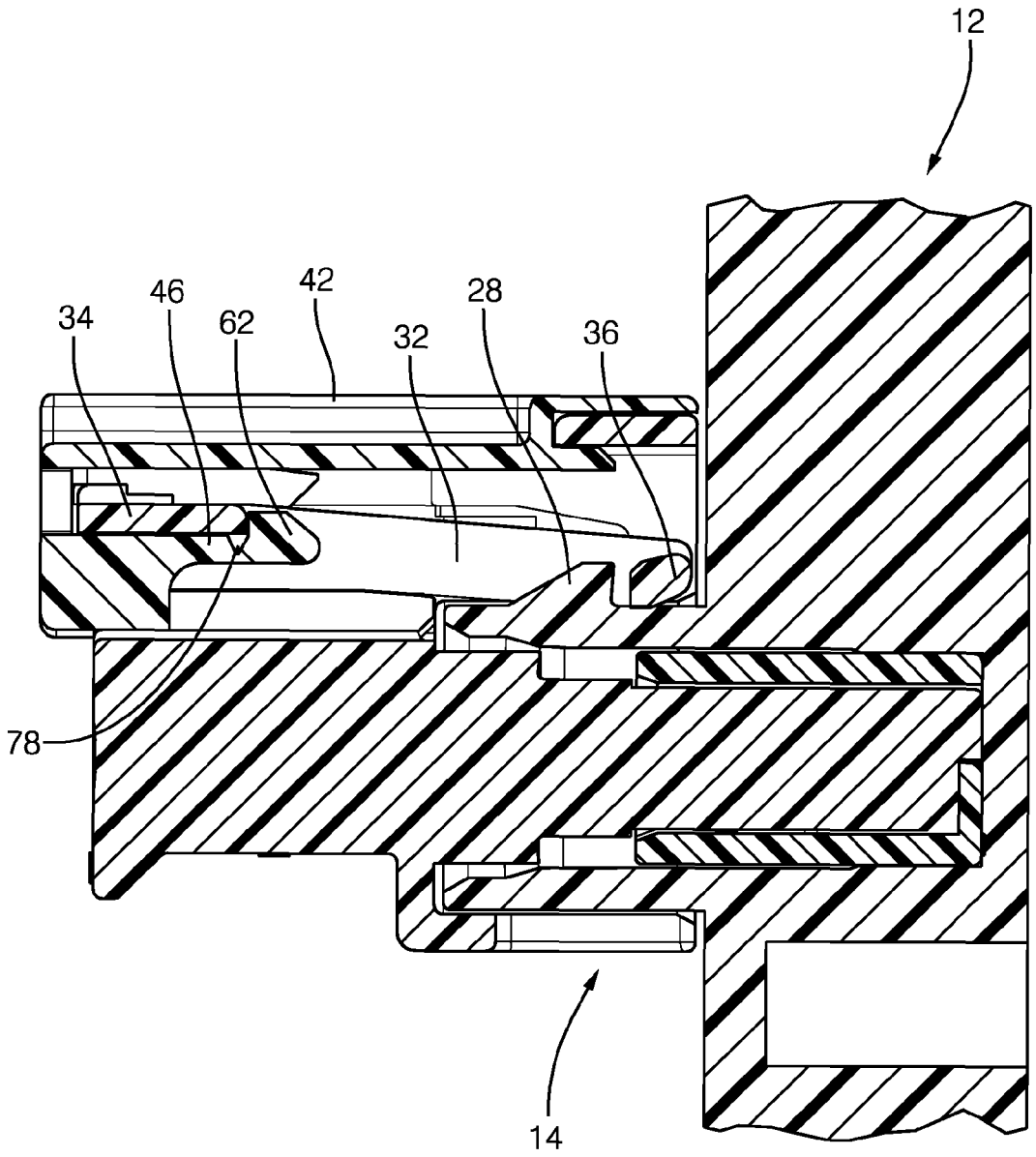
FIG. 7 is a cut-away side view of a connector system of according to another embodiment.
Figure 8:
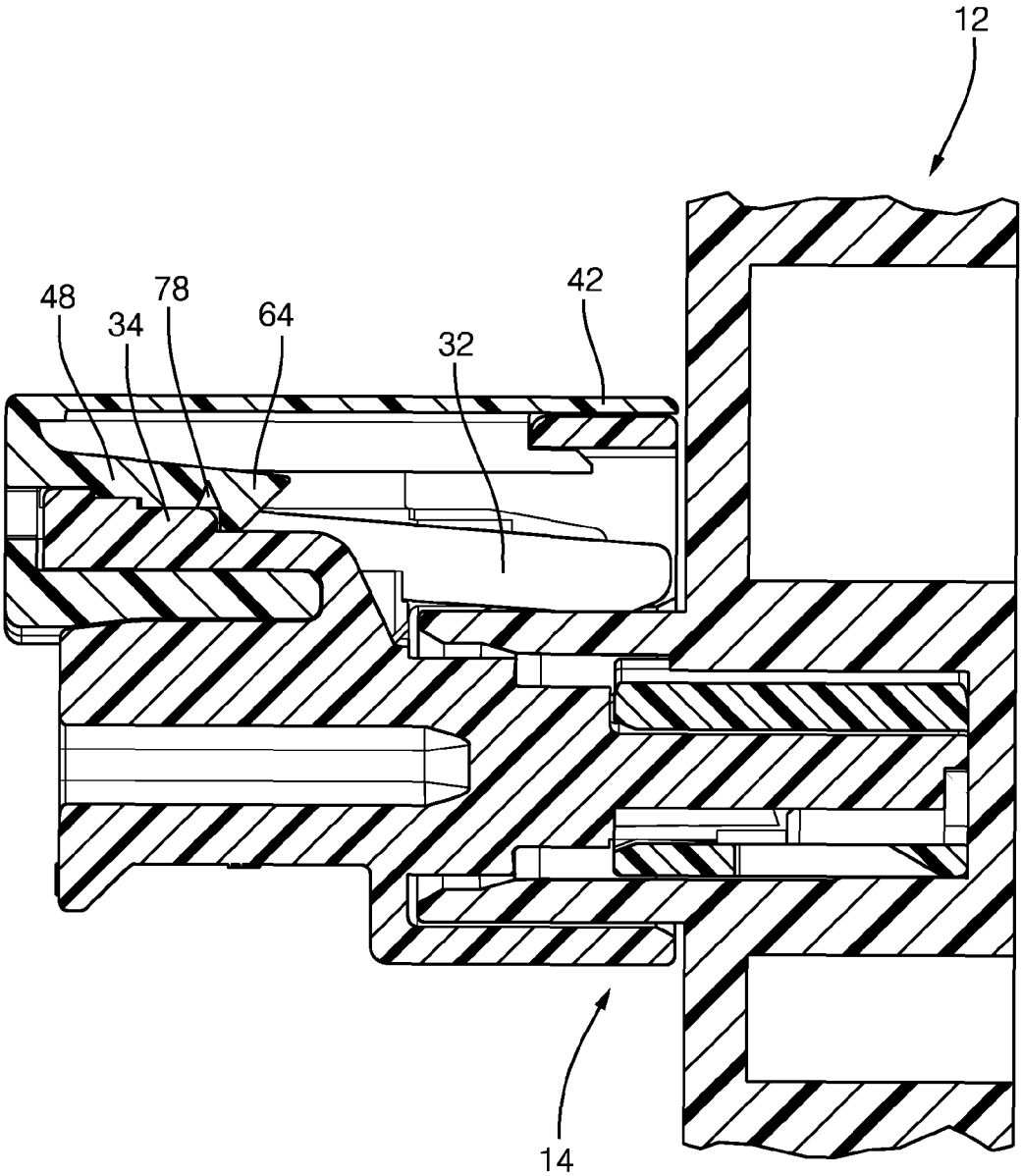
FIG. 8 is another cut-away side view of a connector system of according to another embodiment.
Figure 9:
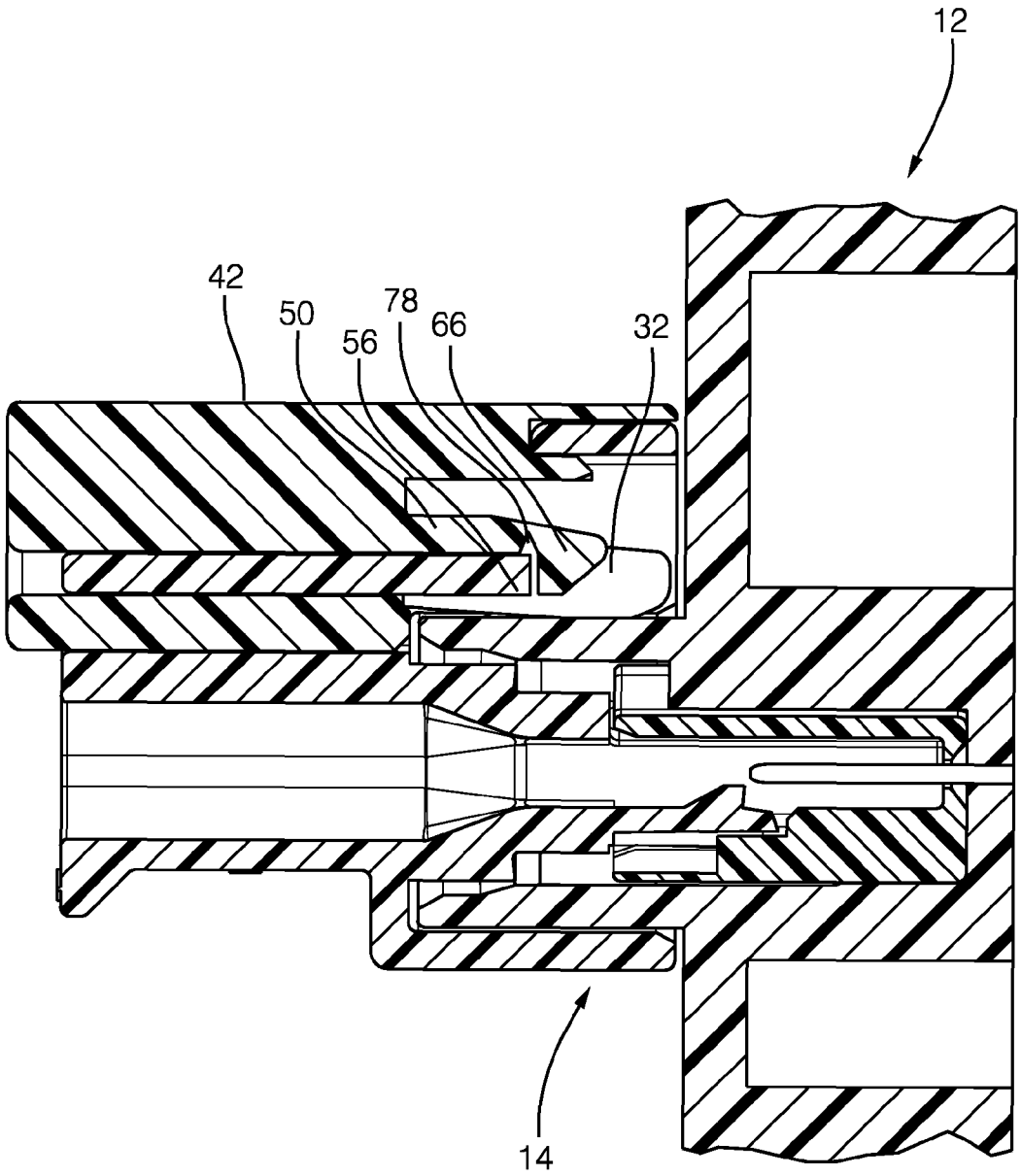
FIG. 9 is yet another cut-away side view of a connector system of according to another embodiment.

It may be desirable to permit removal of the CPA device 42 after it is locked in the final position, therefore an embodiment of the connector system 10 includes apertures 74 in the rear wall 44 as illustrated in FIG. 6 that allow access to the tongue 46, first CPA lock arms 48, and second CPA lock arms 50 so that they could be released from the by inserting a tool (not shown), such as a pick or flat blade screwdriver through the aperture allowing the CPA device 42 to be removed from its final position. The apertures 74 are at least partially covered by a frangible break away tab 76 that would need to be removed by being broken out in order to get access to via the tool. The broken tabs 76 and open apertures 74 could provide visual evidence of disconnecting the first and second connectors 12, 14. Alternatively, the tongue 46, first CPA lock arms 48, and second CPA lock arms 50 may have frangible sections 78 as shown in FIGS. 7-9 that would allow the teeth 62, 64, 66 on the ends of these features to easily break away and allow the CPA device 42 to be removed from its final position in order to disconnect the first connector 12 from the second connector 14. The broken tongue 46, first CPA lock arms 48, and second CPA lock arms 50 could also provide visual evidence of disconnecting the first and second connectors 12, 14. It is preferable for the CPA device 42 to show evidence of disconnecting or tampering because the replacement cost of the CPA device 42 is much lower than the replacement cost of the first or second connector 14.

Alternative embodiments of the connector system 10 may be envisioned in which the first and/or second CPA lock arms are deleted. In other alternative embodiments, the CPA lock arms may be defined by the second connector body and the CPA device may define latch feature with which they engage.

Accordingly a connector system 10 that provides visual evidence of disconnection once the first and second connectors 12, 14 are properly connected is provided. The CPA device 42 of the connector system 10 provides multiple functions: It provides connector positional assurance for the connection between the first and second connectors 12, 14. It covers access to the connections' locking features and may provide a permanent connection that is not serviceable when installed. It provides a disconnection or tamper evident feature that serves as a tell-tale for warranty situations where disconnection of a connector is prohibited.

The examples presented herein are directed to electrical connector systems. However, other embodiments of the connector system may be envisioned that are adapted for use with optical cables or hybrid connections including both electrical and optical cables. Yet other embodiments of the connector system may be envisioned that are configured for connecting pneumatic or hydraulic lines.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector system, comprising:

a first connector body having a connector latch;

a second connector body configured to mate with the first connector body, comprising:

a flexible connector lock arm defined by the second connector body configured to engage the connector latch, thereby securing the second connector body to the first connector body, said flexible connector lock arm having a pressing area near the rear end of the flexible connector lock arm that, when pressed by an operator causes the flexible connector lock arm to pivot and disengage the connector latch, a pair of side walls projecting from the second connector body that extend longitudinally on each side of the flexible connector lock arm, and a front wall located forward of the connector lock arm extending laterally and interconnected to the forward ends of the side walls; and a connector position assurance (CPA) device comprising:

a rear wall extending laterally and a top wall abutting the rear wall, a tongue that engages with the flexible connector lock arm when in a final position, thereby inhibiting movement of the CPA device from the final position, and a flexible CPA lock arm configured to engage the flexible connector lock arm and secure the CPA device to the second connector body, thereby inhibiting disengagement of the CPA device from the flexible connector lock arm, wherein the side walls, front wall, top wall, and rear wall cooperate to enclose the pressing area of the flexible connector lock arm and the flexible CPA lock arm when in the final position, thereby inhibiting access by the operator to the pressing area of the flexible connector lock arm to prevent disengagement of flexible connector lock arm from the connector latch and thereby inhibiting access by the operator to the flexible CPA lock arm to prevent disengagement of the flexible CPA lock arm from the flexible connector lock arm.

2. The connector system according to claim 1, wherein the first connector body includes a first electrical terminal and the second connector body includes a second electrical terminal configured to mate with the first electrical terminal.

3. The connector system according to claim 1, wherein a portion of the flexible CPA lock arm is configured to be frangible.

4. The connector system according to claim 1, wherein the second connector body and/or the CPA device defines an aperture configured to provide access to the flexible CPA lock arm and wherein the aperture is at least partially blocked by a frangible tab.

* * * * *